US005988924A

United States Patent [19]

Chen

[11] Patent Number: 5,988,924

[45] Date of Patent: Nov. 23, 1999

[54] CAR WASHING DEVICE

[76] Inventor: Yun-Ying Chen, 3F, No. 6, Lane 78, Yu-Shih Rd,Wu Ku Hsiang, Taipei Hsien, Taiwan

[21] Appl. No.: 09/208,633

[22] Filed: Dec. 8, 1998

[51] Int. Cl.[6] ..... A46B 11/02; A46B 11/06

[52] U.S. Cl. ..... 401/290; 401/22; 401/27; 401/137; 401/266; 401/289

[58] Field of Search ..... 401/489, 22, 25, 401/26, 27, 137, 139, 261, 266, 290; 15/244.1, 176.5

[56] References Cited

U.S. PATENT DOCUMENTS

| | | | |
|---|---|---|---|
| 1,179,918 | 4/1916 | Hayden | 15/220.1 |
| 1,884,018 | 10/1932 | Lowder | 401/266 |
| 1,887,893 | 11/1932 | Schlyfestone | 401/290 X |
| 2,542,709 | 2/1951 | Rowland | 15/176.5 |
| 3,089,181 | 5/1963 | Hess | 401/139 X |
| 3,176,339 | 4/1965 | McDonald et al. | 401/22 |
| 3,775,017 | 11/1973 | Jerry | 401/266 |
| 5,448,793 | 9/1995 | Mallory et al. | 15/244.1 X |

*Primary Examiner*—Steven A. Bratlie
*Attorney, Agent, or Firm*—Pro-Techtor International Services

[57] ABSTRACT

A car washing device includes an assembly of brushes such as sponge brushes or other equivalents composed of bristles or cloth attached to the front side of a brush body. A hose joint is provided near the hand grip of the brush body for introducing clean water into the device and to supply the water to the brush assembly via at least one water outlet hole in the brush body. A car washer can wash the car with one hand using the device. A valve may be provided to control the flow rate of the water.

3 Claims, 3 Drawing Sheets

CAR WASHING DEVICE

BACKGROUND OF THE INVENTION

1. Field of the Invention

The present invention relates to a car washing device and more particularly to a car washing device with an assembly of brushes attached to its front side. A hose joint is provided near the hand grip of the washing device to introduce clean water into the device and to supply water to the brush assembly via a water outlet hole, thereby enabling the car washer to wash the car with one hand.

2. Description of the Prior Art

When washing a car, most people generally rub the car with a washing brush made of sponge, vinyl, or cotton with one hand, and hold a water hose with the other hand to spray clean water on the car. Inevitably, a car washer washing the car in such a way will be soaked after finishing his/her work. Much of the water is wasted.

SUMMARY OF THE INVENTION

It is an object of the present invention to provide a car washing device with an assembly of brushes such as sponge brushes attached to its front side, and a hose joint provided near the grip of the washing device to introduce clean water into the device and supply the water to the brush assembly via a water outlet hole, thereby enabling the car washer to wash the car with one hand.

To achieve the above mentioned object, the present invention is directed to providing a car washing device comprising a brush body, at least one sponge chuck, and at least one sponge brush or equivalent. The device is characterized in that there is a water passage passing though the central portion of the brush body. Grooved brush seats are included in a sponge chuck made of a resilient material. A central separator is installed along the longitudinal center line of the sponge chuck so as to separate the sponge chuck into two parts. A plurality of gripping protrusions are disposed along the opposing inner surfaces of both the upper and lower gripping straps of the sponge chuck. A slot is formed by cutting into the sponge brush or equivalent. The slot receives the central separator of the sponge chuck. The sponge chuck is inserted into the grooved brush seat on the brush body. In addition, a hose joint is provided at the lower end of the brush body for connecting with a water hose.

By the structure described above, after the sponge chuck and the grooved brush seat have been combined, both gripping straps of the sponge chuck exert a strong gripping force on the brush due to the angle of the brush seats and the engaging force of a plurality of gripping protrusions disposed along the opposing inner surfaces of the two gripping straps. Clean water is introduced into the brush body through the water passage, and is supplied to the brush assembly from at least one water outlet hole bored on the brush body at the back side of the brush assembly. A valve can be installed on the hand grip for controlling the flow rate of water.

BRIEF DESCRIPTION OF THE DRAWINGS

The drawings disclose the illustrative embodiments of the present invention which serve to exemplify the various advantages and objects thereof, and are as follows.

DETAILED DESCRIPTION OF THE PREFERRED EMBODIMENT

Figures 1, 2:
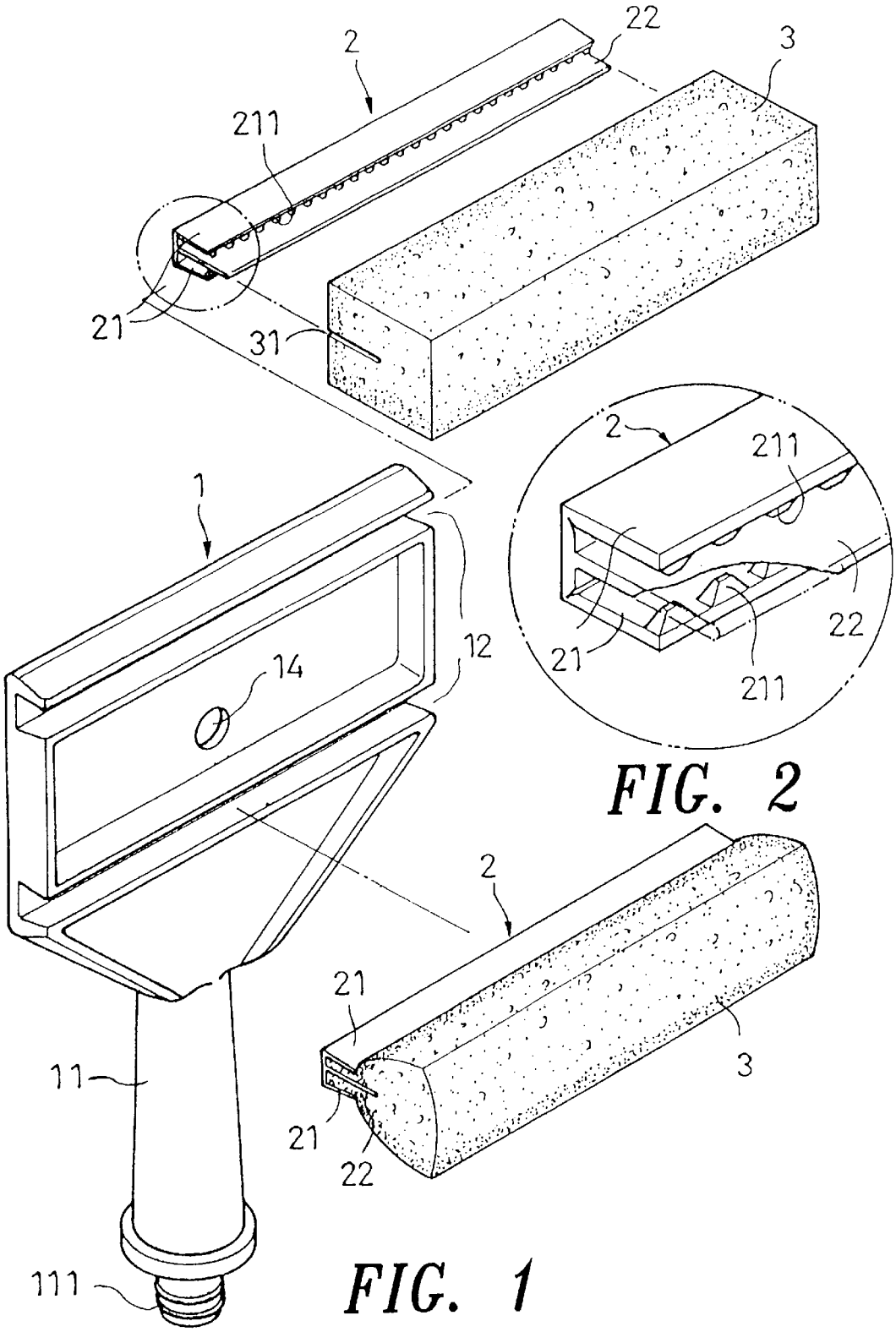
FIG. 1 is a three dimensional exploded view of the car washing device of the present invention.
FIG. 2 is partial enlarged view showing the sponge chuck of the car washing device of the present invention.
Figure 3:
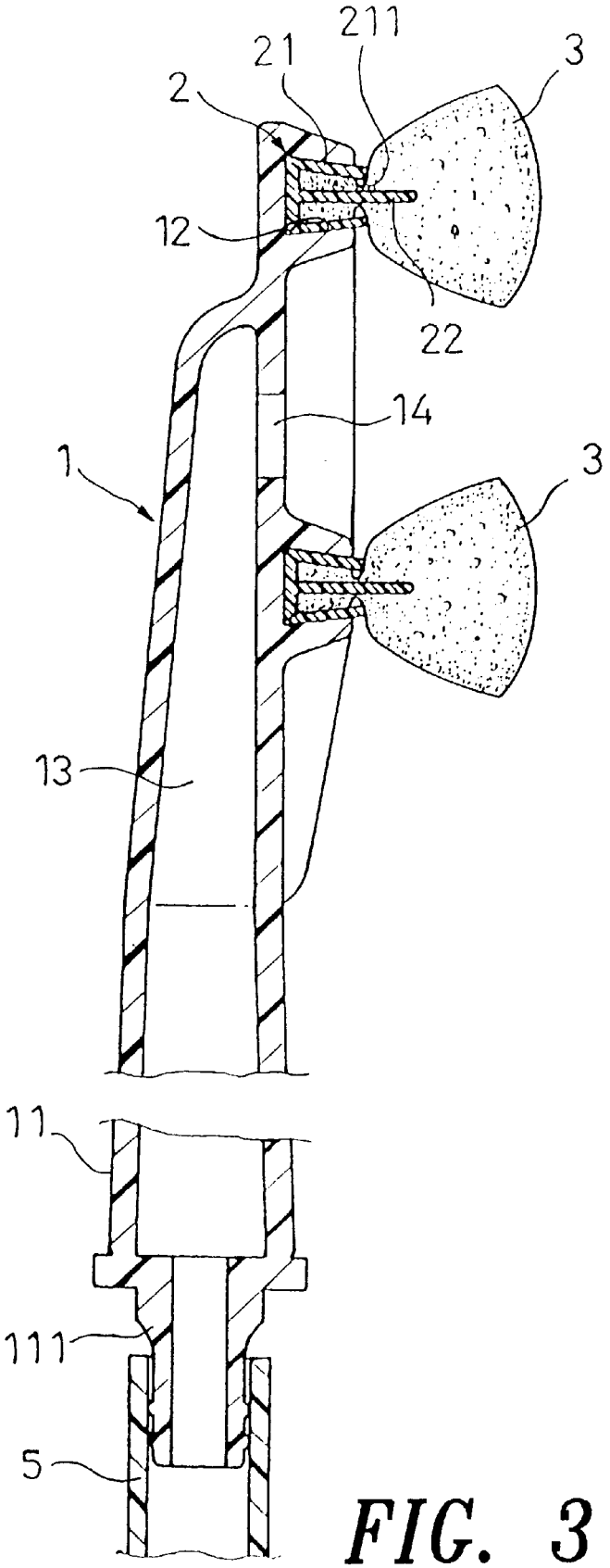
FIG. 3 is a cross section showing the brush assembly of the car washing device of the present invention.
Figure 4:
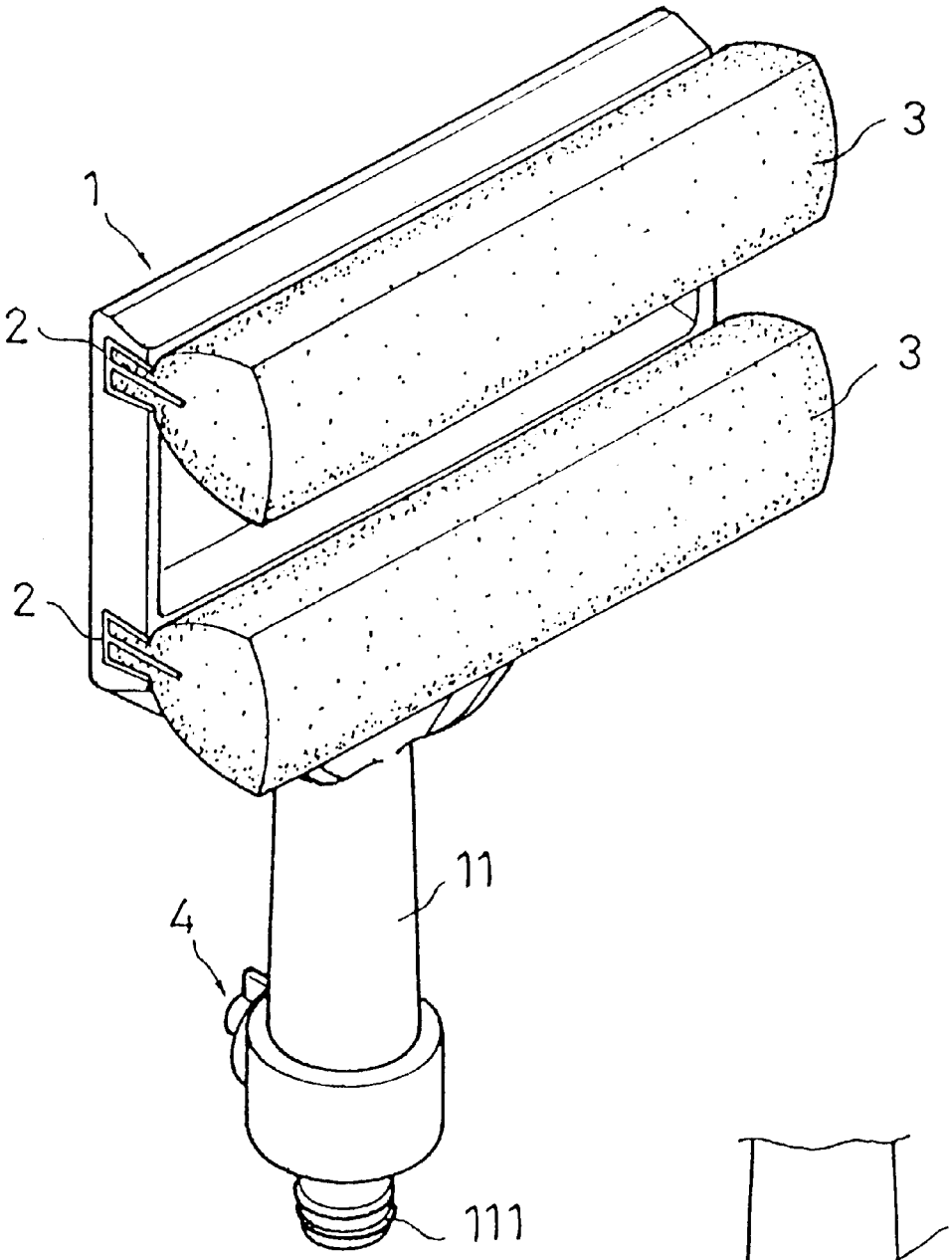
FIG. 4 shows the device with two sponge brushes.

Referring to FIGS. 1 through 3, the car washing device of the present invention comprises a brush body 1, at least one sponge chuck 2, and at least one sponge brush 5 or other equivalent.

A water passage 13 passes through the central portion of the brush body 1. At least one grooved brush seat 12 is formed with inwardly angled walls that receive a sponge chuck 2 made of a resilient material. A central separator 22 is installed along the longitudinal center line of the sponge chuck 2 so as to separate the sponge chuck 2 into two parts. A plurality of gripping protrusions 211 are disposed along the opposing inner surfaces of both the upper and lower gripping straps 21 of the sponge chuck 2. A slot of appropriate depth is formed in the sponge brush 3 or equivalent to receive the central separator 22 of the sponge chuck 2 therein. The sponge chuck 2 is inserted into the brush seat 12 on the brush body 1. A hose joint 111 is provided at the lower end of the brush body 1 for connecting with a water hose.

After the sponge chuck 2 and the grooved brush seat 12 have been combined, both gripping straps 21 of the sponge chuck 2 exert a strong gripping force on the brush towards the central separator 22 due to its angled shape. The sponge brush 3 is also secured by the engaging force of a plurality of gripping protrusions 211 disposed along the opposing inner surfaces of the two gripping straps 21. Clean water is introduced into the brush body 1 through the water passage 13, and is supplied to the brush assembly from at least one water outlet hole 14 in the brush body 1.

Figure 5:
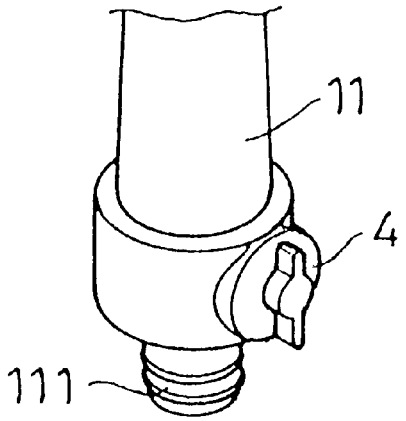
FIG. 5 shows the car washing device in another embodiment of the present invention wherein a valve is provided on the hand grip of the brush body.

Referring to FIG. 5, a valve 4 can be installed on the hand grip 11 for controlling the flow rate of water.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

What is claimed is:

1. A car washing device comprising:

a brush body with a water passage through a central portion of said brush body, said brush body includes a hose joint at a lower end thereof allowing water to flow through said brush body to at least one brush means, a plurality of brush seats provided in said brush body, at least one sponge chuck made of resilient material, said sponge chuck includes a central separator and upper and lower gripping straps, said gripping straps include thereon a plurality of gripping protrusions to secure one of said brush means therein, each said brush means includes a slot therein to receive said central separator of said sponge chuck, said brush means being secured in said sponge chuck, and said sponge chuck being removably secured in one of said brush seats; such that a number of said brush means utilized in said brush body can be varied by a user of said car washing device, a maximum number of said brush means being defined by a number of said brush seats provided in said brush body.

2. The car washing device as claimed in claim 1, wherein:

said brush means is formed from sponge, vinyl, or cotton.

3. The car washing device as claimed in claim 1, wherein:

a valve is included in a hand grip of said brush body to control a flow rate of water through said brush body.

* * * * *